United States Patent [19]

Kern et al.

[11] 4,447,211

[45] May 8, 1984

[54] SIMULATED PORTABLE ROCKET LAUNCHER

[75] Inventors: Bernd M. Kern, Stuvenborn; Werner Hasse, Neu Wulmstorf, both of Fed. Rep. of Germany

[73] Assignee: Precitronic Gesellschaft fur Feinmechanik und Electronic mbH, Hamburg, Fed. Rep. of Germany

[21] Appl. No.: 397,502

[22] Filed: Jul. 12, 1982

[30] Foreign Application Priority Data

Dec. 2, 1981 [CH] Switzerland ..... 7716/81

[51] Int. Cl.[3] ..... G09B 9/00; F41F 27/00

[52] U.S. Cl. ..... 434/12; 434/18

[58] Field of Search ..... 434/11, 12, 16, 18, 434/24

[56] References Cited

U.S. PATENT DOCUMENTS 3,334,425 8/1967 Öhlund ..... 434/16

4,050,166 9/1977 Swiatosz et al. ..... 434/18

*Primary Examiner*—William H. Grieb

*Attorney, Agent, or Firm*—Walter H. Schneider

[57] ABSTRACT

A portable apparatus having the shape, and intended to simulate the firing, of an actual rocket launcher. The simulated portable rocket launcher, used in conjunction with a laser device, comprises a tubular casing having mounted thereon an aiming device. A unit of similar shape designed to be inserted in said casing, has front and rear end plates between which extends a bar surrounded by a spiral spring, an annular shaped mass representing a rocket being movably mounted through its annulus on said bar. Locking and triggering means are provided to secure the mass to the rear end plate in a ready-to-fire position, while a resilient stop member for the movable mass is provided at the front end plate. Activation of the triggering means releases the mass from the rear end plate and activates the laser device which directs a beam on the target. Movement of the mass along the bar is terminated at the front end plate by the resilient stop means. To effect another firing, the insertable unit is removed from the casing, the mass placed in the ready-to-fire position against the rear end plate, and the unit re-inserted in the casing. The simulated portable rocket launcher permits a marksman to experience the recoil of a rocket while practicing control of aim throughout the flight of the rocket from launch to target strike.

5 Claims, 2 Drawing Figures

SIMULATED PORTABLE ROCKET LAUNCHER

BACKGROUND OF THE INVENTION

1. Field of the Invention

The present invention relates to a portable apparatus intended for simulating the launching of rocket ammunition.

When firing at a target by means of a portable rocket launcher, many weapon systems demand that the marksman keep the target in the sighting device during the flight of the rocket. Specifically, during the final portion of the flight of the rocket, the marksman must maintain his aim at the target so that the guidance control, which is usually mounted on the casing of the launcher, will not emit erroneous direction commands to the rocket thereby leading to a miss of the target.

2. Description of the Prior Art

A variety of rocket launching simulators have been designed for exercising optical targeting during the flight phase of a rocket. Such simulators normally operate in conjunction with a laser beam emitting device located on the housing of the rocket launcher, whereby continuous aim at the target via the visor line can be controlled and the time of flight of the launched rocket can be simulated.

While these known simulators allow controlling the aim at the target during the complete flight time of the rocket, nevertheless, the dynamic behavior of the rocket launcher is not taken into consideration. Accordingly, it is of great importance that a marksman be familiarized with the dynamic launching behavior of a rocket launcher by simulated launching means, since a shifting of the center of gravity and of dynamic forces under actual rocket launching can lead to a missed target. Of special importance is proper maintenance of the target in the aiming device of the launcher during launch of the rocket.

SUMMARY OF THE INVENTION

It is the general object of the present invention, therefore, to provide a portable apparatus having the shape of an actual rocket launcher and designed to simulate the launch of a rocket. A further object of this invention is to provide a simulated portable rocket launcher comprising a mass body, or element movable along a guiding means extending in a longitudinal direction within a tubular casing, propelling means being provided within the casing between the front and rear ends thereof, the front end being further provided with resilient means for stopping the movement of the body, or element. The simulated portable rocket launcher permits a functionally correct simulation of the dynamic behavior of an actual rocket launcher during launch, as well as throughout the entire flight of the rocket until striking the target.

BRIEF DESCRIPTION OF THE DRAWINGS

In the drawings, which illustrate that which is presently regarded as the best mode for carrying out the invention.

DETAILED DESCRIPTION OF THE PREFERRED EMBODIMENT

Figure 1:
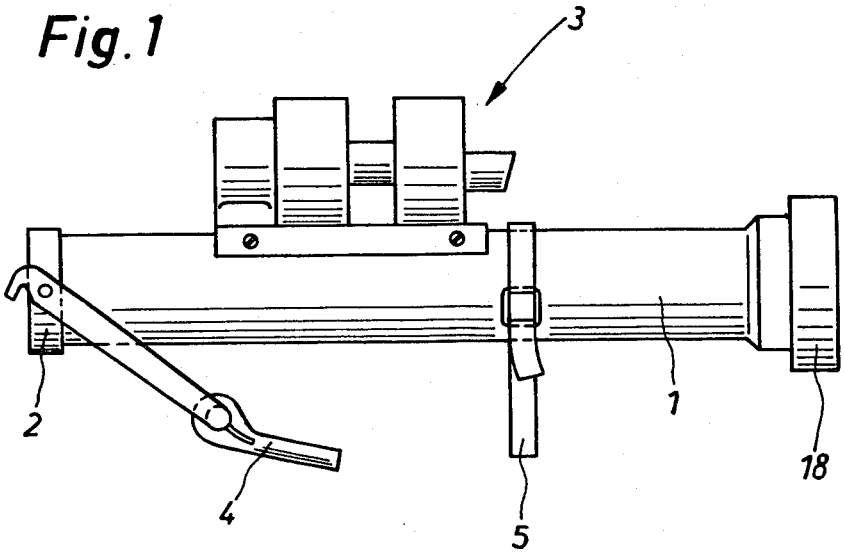
FIG. 1 is a schematic view of a portable apparatus in the shape of and intended to simulate a rocket launcher.

Turning now to FIG. 1 of the drawings, there is shown therein a simulated portable rocket launcher comprising a tubular casing 1 shaped as a rocket launcher having a front end 2 and a rear end 18. An aiming device 3 is located on the top of casing 1, while support members 3 and 4 are located at its lower area. The launcher is provided with means, not shown, for triggering a simulated rocket launch.

Figure 2:
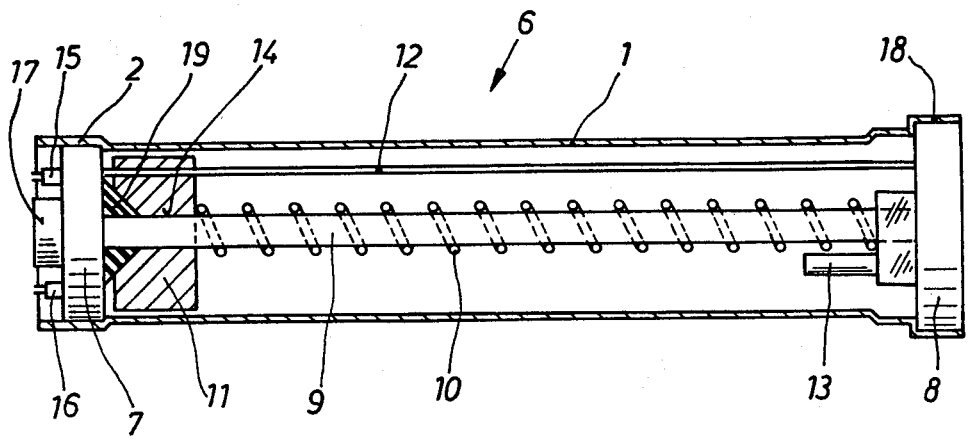
FIG. 2 is a schematic view of the inner unit of the simulated portable rocket launcher of FIG. 1.

A unit 6, illustrated in FIG. 2, is located within the casing 1, and comprises a front end plate 7 and a rear end plate 8. A gliding bar 9, surrounded by a spiral pressure spring 10, extends between front and rear plates 7 and 8. A mass body 11 having an annular shape and intended to simulate rocket ammunition, is movably mounted through its annulus on gliding bar 9. In order to minimize the effect of friction as mass body 11 moves on bar 9, there is provided a bearing arrangement, which may be of any conventional design, positioned in the annulus of mass body 11. A thin bar 12 extending between and parallel to front and rear end plates 7 and 8 and through an opening in mass body 11, also provided with a bearing arrangement, serves to prevent rotation of mass body 11 as it moves on gliding bar 9. A control means 13 extending parallel to gliding bar 9 is mounted on rear end plate 8.

As shown in FIG. 2, mass body 11 is located at its front end position situated against a resilient stop member 19 secured to front end plate 7. Stop member 19 is preferably cone-shaped and designed to seat in a reciprocally shaped indentation in mass body 11. Spiral pressure spring 10 serves to move mass body 11 from its rear position against rear end plate 8 when under tension, to its front position of FIG. 2 when tension is released, spring 10 being supported at one end by rear end plate 8 and at the other end by mass body 11.

As shown in FIG. 2, unit 6 is provided with suitable electrical or electronic control devices 15, 16 and 17, the specific details of which are not depicted, for operating the laser device associated with the aiming device of the simulated rocket launcher whereby target distance and rocket flight time are established.

Unit 6 is similarly shaped to casing 1 and is adapted to be inserted axially thereinto and locked in place. After each simulated rocket launch, unit 6 is withdrawn from casing 1 and mass body 11 moved from its forward fired position rearwardly against the force of pressure spring 10 into its rear ready-to-fire position, in which it is secured by locking means operated by triggering means, not shown. In this rear, locked position, mass body 11 represents a simulated ready-to-fire rocket. Unit 6 is then re-inserted into casing 1 and the simulated rocket launcher is ready for another single simulated launch.

In operation, activation of the triggering means at end plate 8 initiates electronic means 15, 16 and 17 causing a laser beam to be aimed from the emitter of the laser device associated with the simulated portable rocket launcher onto a target, the reflection from which is received by the receiver of the laser device thereby establishing the distance and duration of flight of the simulated rocket. Operation of the triggering means also releases the locking means securing mass body 11 to the rear end plate 8 causing it to move forwardly by virtue of spring 10 towards the front end plate 7 thereby simulating the dynamic behavior of an actual rocket firing. The movement of mass body 11 is terminated when it strikes stop member 19, the elastic absorbing effect of which may be empirically claculated and selected so as to simulate the recoil effect that the marksman would experience under actual rocket launching conditions. By means of empirically determining the desired absorbing effect of stop member 19 with respect to mass body 11, and establishing the desired tension properties of spring 10, the dynamic behavior of the simulated portable rocket launcher of this invention can be made to closely simulate the actual firing of a rocket from initial launch through its entire flight until striking the target so that control of aim can be practiced throughout by the marksman.

Simulated control of the aim of the launcher throughout launch and flight of the rocket by means of the laser beam directed along the line of aim can proceed with actuation of the triggering means as above described. Alternatively, the laser beam can be switched in after mass body 11 has reached an intermediate point in its flight, or at the end of flight as in FIG. 2. When mass body 11 is in the position of FIG. 2, for instance, electronic devices 15, 16 and 17 can be operated by mass body 11 through appropriated switch means so that the laser device is placed in operation.

By suitable modification of the properties of spring 10, the size and mass of mass body 11, and the resiliency properties of stop member 19, the simulated portable rocket launcher of this invention can be adapted to simulate actual rocket and rocket launchings of varying characteristics. The launcher of this invention, moreover, requires only spring member 10 as a source of energy, any additional energy sources such as electric batteries, pressurized air or other gas, or the like being totally unnecessary.

As above described, the simulated protable rocket launcher of this invention is placed in the ready-to-fire position simply by manually tensioning spring member 10. Alternatively, however, the launcher can be so designed by taking into consideration the characteristics of mass body 11 and tension spring 10 so as to accomplished this simply by placing unit 6 in a vertical position whereby the force of gravity moves mass body 11 into the ready-to-fire position in which it automatically locked ready for a simulated firing.

What is claimed is:

1. A portable apparatus having the shape of a rocket launcher and adapted to be used in conjunction with a laser aiming device, which comprises: a tubular casing adapted to have removably inserted therein a unit of similar shape, said unit comprising front and rear end plates and a gliding rod extending axially therebetween; an annular-shaped mass body mounted on said gliding rod extending through its annulus and adapted to move therealong between said front and rear end plates; a compression spring surrounding said gliding rod extending between said mass body and said rear end plate; a resilient stop member positioned at said front end plate; means for securing said mass body under the compressive force of said spring to said rear end plate; and triggering means for releasing said mass body from said rear end plate thereby propelling it under the force of said spring along said gliding rod toward said front end plate, said stop means terminating the movement and absorbing the force of said mass body.

2. An apparatus according to claim 1 in which said mass body is movably mounted on a second rod extending parallel to said gliding bar and extending between said front and rear end plates, said second bar preventing rotation of said mass body as it moves along the gliding rod.

3. An apparatus according to claim 2 in which said resilient stop means is in the form of a cone surrounding said gliding rod, said cone-shaped stop means being adapted to seat in a reciprocally-shaped indentation in said mass body.

4. An apparatus according to claim 3 in which the mountings of said mass body on said gliding rod and said second rod are friction-reducing mountings.

5. An aaparatus according to claim 3 in which a laser aiming device activated by means located in said insertable unit is mounted on said tubular casing, said device being adapted to send impulses to and receive impulses from a target.

* * * * *